US008534392B2

(12) United States Patent
Lynde et al.

(10) Patent No.: US 8,534,392 B2
(45) Date of Patent: Sep. 17, 2013

(54) COMPOSITE CUTTING/MILLING TOOL HAVING DIFFERING CUTTING ELEMENTS AND METHOD FOR MAKING THE SAME

(75) Inventors: Gerald D. Lynde, Houston, TX (US); James McNicol, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 425 days.

(21) Appl. No.: 12/709,930

(22) Filed: Feb. 22, 2010

(65) Prior Publication Data

US 2011/0203856 A1 Aug. 25, 2011

(51) Int. Cl.
*E21B 10/42* (2006.01)

(52) U.S. Cl.
USPC ..... 175/430; 175/426; 76/108.4

(58) Field of Classification Search
USPC ..... 175/398, 426, 430; 76/108.2, 108.4
See application file for complete search history.

(56) References Cited

U.S. PATENT DOCUMENTS

| | | | | |
|---|---|---|---|---|
| 4,343,371 | A * | 8/1982 | Baker et al. | 175/430 |
| 4,512,426 | A * | 4/1985 | Bidegaray | 175/430 |
| 4,602,691 | A * | 7/1986 | Weaver | 175/430 |
| 4,718,505 | A * | 1/1988 | Fuller | 175/428 |
| 4,719,979 | A * | 1/1988 | Jones | 175/430 |
| 4,889,017 | A * | 12/1989 | Fuller et al. | 76/108.2 |
| 5,607,024 | A * | 3/1997 | Keith et al. | 175/431 |
| 6,068,913 | A | 5/2000 | Cho et al. | |
| 6,511,265 | B1 | 1/2003 | Mirchandani et al. | |
| 7,677,333 | B2 * | 3/2010 | Mensa-Wilmot | 175/57 |
| 2005/0133277 | A1 * | 6/2005 | Dixon | 175/426 |
| 2006/0032677 | A1 * | 2/2006 | Azar et al. | 175/430 |
| 2006/0070771 | A1 * | 4/2006 | McClain et al. | 175/57 |
| 2007/0042217 | A1 | 2/2007 | Fang et al. | |
| 2008/0035388 | A1 * | 2/2008 | Hall et al. | 175/429 |
| 2011/0192653 | A1 * | 8/2011 | Stowe, II | 175/430 |

FOREIGN PATENT DOCUMENTS

WO 2006134944 A1 12/2006

OTHER PUBLICATIONS

Cherkashin, V. P., "Composite Cutting Tool," Russian Engineering Research, vol. 28, No. 7, Jul. 2008, pp. 701-702.

Kumar, A. Senthil et al. "Development of Alumina-Ceria Ceramic Composite Cutting Tool" [Abstract Only], International Journal of Refractory Metals and Hard Materials, vol. 22, Issue 1, Jan. 2004, pp. 17-20.

International Search Report and Written Opinion, Date of mailing Oct. 26, 2011, International Application No. PCT/US2011/025706, Korean Intellectual Property Office, International Search Report 7 pages, Written Opinion 4 pages.

* cited by examiner

*Primary Examiner* — Shane Bomar
*Assistant Examiner* — Blake Michener
(74) *Attorney, Agent, or Firm* — Cantor Colburn LLP

(57) ABSTRACT

A cutting/milling tool includes a tool body, a cutting end of the tool body, a first plurality of cutting elements having a substantially identical shape disposed at the cutting end of the tool body, and a second plurality of cutting elements having a different shape than the first plurality of cutting elements. The second plurality of cutting elements are substantially identical in shape to each other, and the second plurality of cutting elements are interspersed with the first plurality of cutting elements at the cutting end of the tool body. Also included is a method for making a cutting/milling tool.

14 Claims, 9 Drawing Sheets

COMPOSITE CUTTING/MILLING TOOL HAVING DIFFERING CUTTING ELEMENTS AND METHOD FOR MAKING THE SAME

BACKGROUND

Cutting and milling tools are old in the drilling and completion industry. Crushed carbide tipped cutting and milling tools go back at least to 1945 and are very effective and hence ubiquitously used in the industry. The longevity of the commercial use of such tools is testament to their effectiveness in the field. And while crushed carbide is still being used today, and will likely continue to be used, improvements are always well received by the art.

SUMMARY

A cutting/milling tool includes a tool body; a cutting end of the tool body; a first plurality of cutting elements having a substantially identical shape disposed at the cutting end of the tool body; and a second plurality of cutting elements having a different shape than the first plurality of cutting elements, the second plurality of cutting elements being substantially identical in shape to each other, the second plurality of cutting elements being interspersed with the first plurality of cutting elements at the cutting end of the tool body.

A method for making a cutting/milling tool includes selecting a first plurality of consistently shaped and sized cutting elements; selecting a second plurality of consistently shaped and sized cutting elements; and attaching each plurality of cutting elements to a cutting end of the tool.

BRIEF DESCRIPTION OF THE DRAWINGS

Referring now to the drawings wherein like elements are numbered alike in the several Figures.

DETAILED DESCRIPTION

Figure 1:
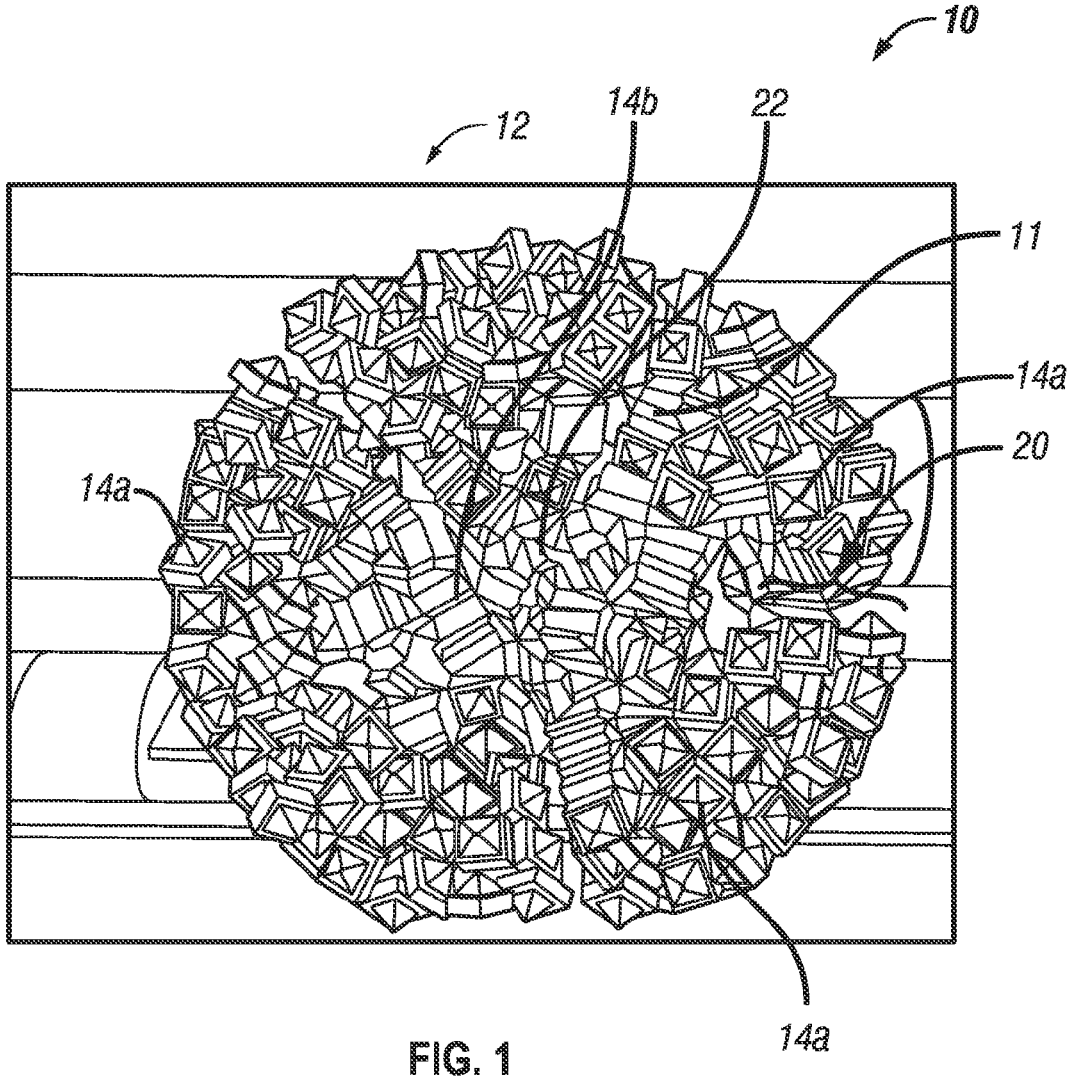
FIG. 1 is an end view of a cutting or milling tool illustrating a plurality of cutting elements that include differing properties.

Referring to FIG. 1, one embodiment of a composite cutting tool 10 is illustrated. The tool 10 comprises a tool body 11 having a cutting end 12 thereof provided with a plurality of cutting elements 14*a* and 14*b* (see FIGS. 2 and 3). The elements 14 (collectively) comprise two or more pluralities of consistent shapes. In addition, one or more of the different shapes may also be of different size and different hardness. Each of the elements of like shape and size are substantially identical to each other. It is to be understood however that there are, in all embodiments, at least two pluralities of cutting elements that are different from each other at least in shape and that within each plurality of elements, the shape will be consistent. The like elements (a plurality of elements) may be either all of the same hardness or of different hardness. If a particular element is of a particular shape and/or size then all of the elements that are intended to be like that one will be substantially identical to it. Elements of another shape and/or size are likewise substantially identical to each other. It is further noted that shapes of elements may be duplicated in different sizes but the differently sized and shapes will form their own plurality of elements such that consistency within any particular plurality is maintained.

In order to achieve the sameness that is disclosed hereinabove. The cutting elements are preshaped in any suitable manufacturing process where randomness is avoided. In one iteration of the invention, the elements are all cast elements to ensure the sameness among shapes that are intended to be the same as each other. One composition for the elements is a sintered carbide material with a cobalt binder. The material itself will be familiar to those of skill in the art.

Figure 2:
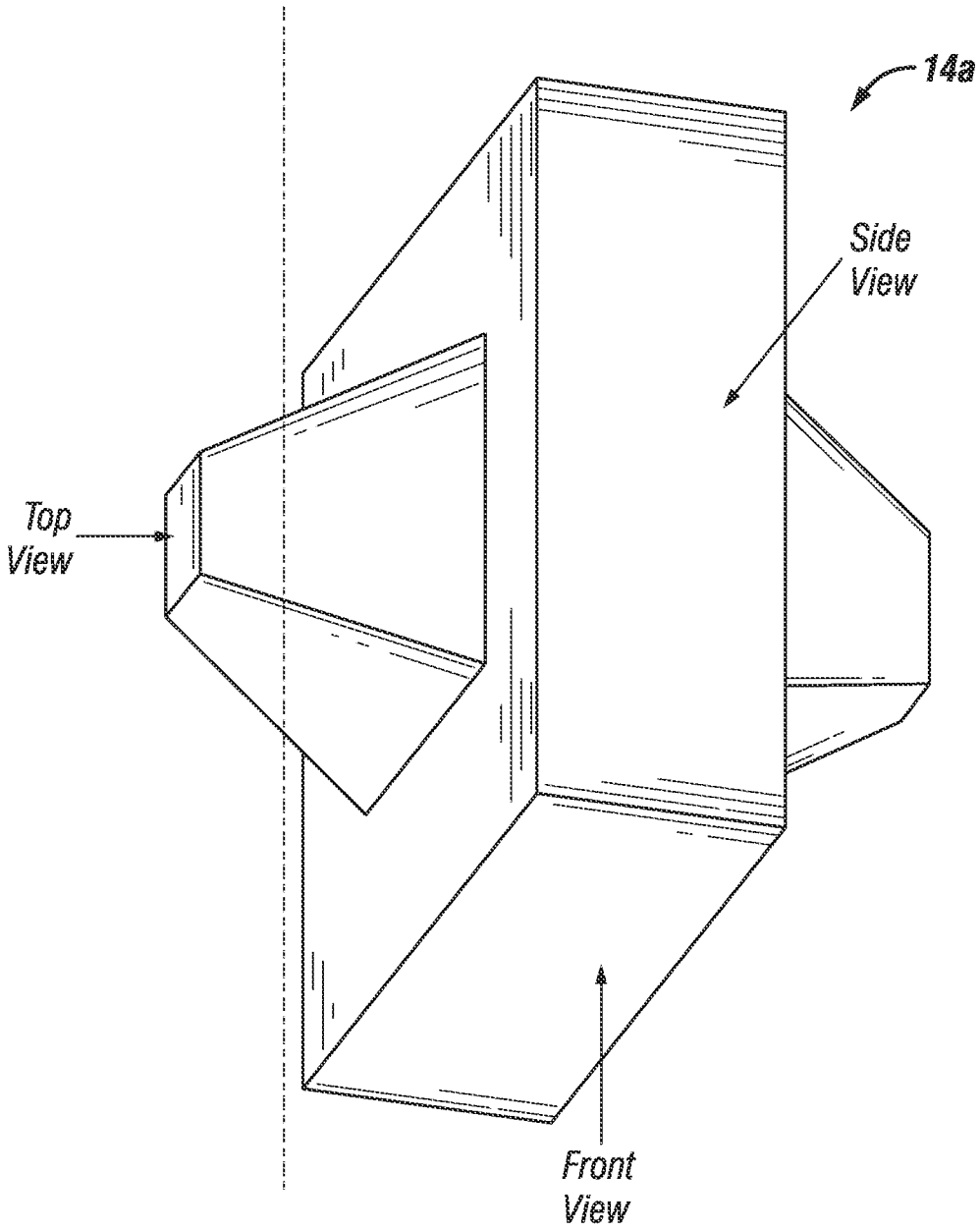
FIG. 2 is a perspective view of a cast carbide cutting element used in conjunction with the composite cutting/milling tool.
Figure 3:
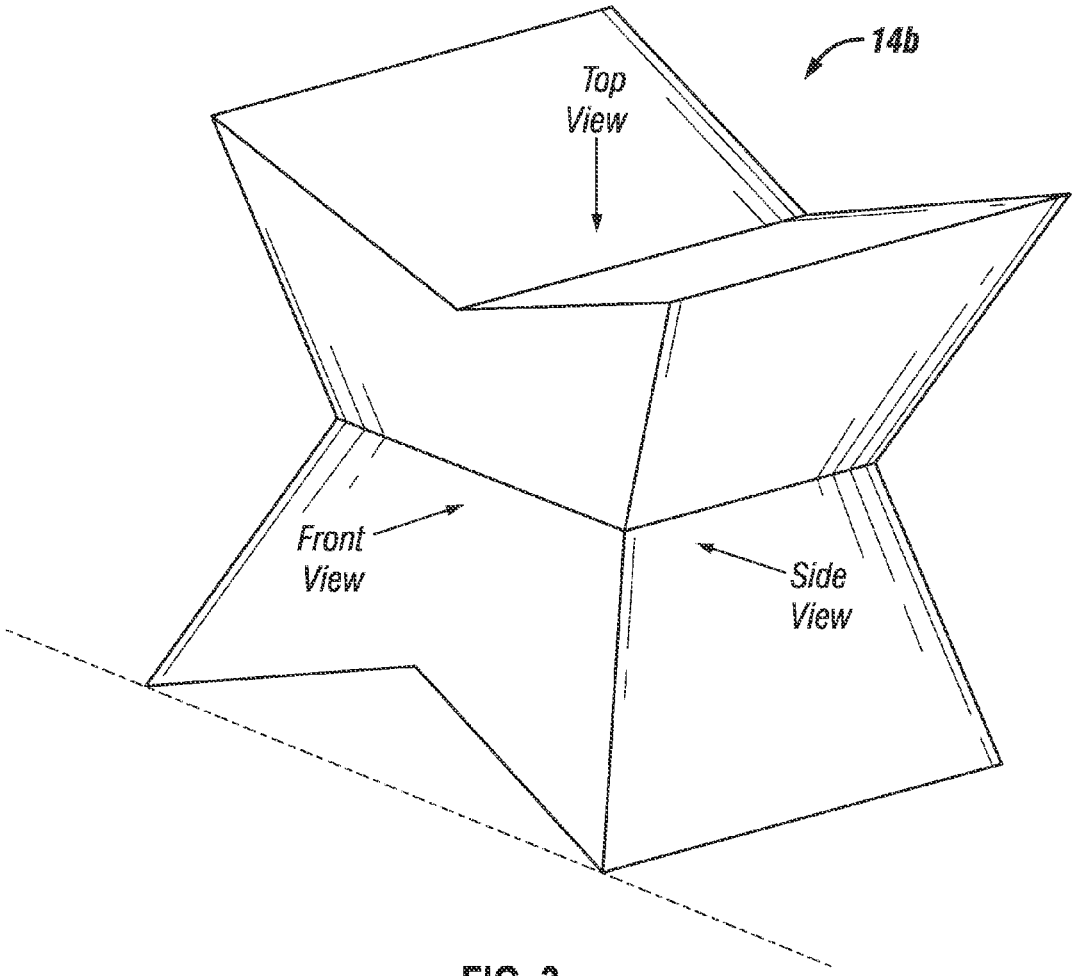
FIG. 3 is a view of another cast carbide cutting element used in conjunction with the composite cutting tool.

In a particular embodiment illustrated in FIG. 1, two pluralities of consistently shaped elements 14 are disposed over a surface of the cutting end 12 of the tool. In the illustrated embodiment, one plurality of elements 14*a* is shaped as illustrated in FIG. 2 while the second plurality of elements 14*b* is shaped as illustrated in FIG. 3. It has been discovered by the Applicant that cutting/milling performance is improved by this configuration. Each of the plurality of elements 14 is attached to the tool body 11 using a media capable of bonding the elements 14 in place and that can withstand the rigors of cutting/milling in a downhole environment. In one embodiment, the material is a copper nickel braze.

In another embodiment, the elements 14 are arranged on the cutting end 12 so that ones of the plurality of elements having a greater hardness are positioned toward a periphery 20 of the cutting end 12 whereas ones of the plurality of elements having lesser hardness are arranged on the cutting end 12 of the tool 10 more toward an axis 22 thereof. This is helpful in cutting efficiency because the periphery of the cutting end 12, when milling a packer for example, is exposed to the slips of the packer, which are harder than other portions of the packer. Cutting efficiency is improved hereby since the wear characteristic of the greater hardness elements at the periphery of the tool 10 are better matched to the task of milling the slips without premature dulling of the cutting elements.

As noted above, pluralities of elements 14 can be of differing sizes. This can provide a benefit to longevity of the tool 10 since the pluralities of elements having smaller size can be interspersed with those having larger sizes thereby reducing the potential for the surface being milled to come into contact with the attaching material. As one of skill in the art will recognize, attachment materials such as copper nickel braze become relatively lubricious when subjected to large shear forces inherent in cutting/milling operations. Therefore reducing potential shear force input to the material is a benefit.

Because of the consistent shape and size of elements 14, tool dimensions are significantly more precise and repeatable than they have been in the past. This translates into reduce manufacturing costs and improved redressing success in the field. The method for making a cutting/milling tool as disclosed herein includes selecting at least two pluralities of cutting elements having a consistent shape and size. These elements are then attached to the tool body 11 by an attaching material such as copper nickel braze by brazing. The method may in some embodiments also include positioning individual ones of the pluralities of shapes having a greater hardness than other individual ones of the pluralities of shapes nearer a periphery of the tool 10.

Figure 4:
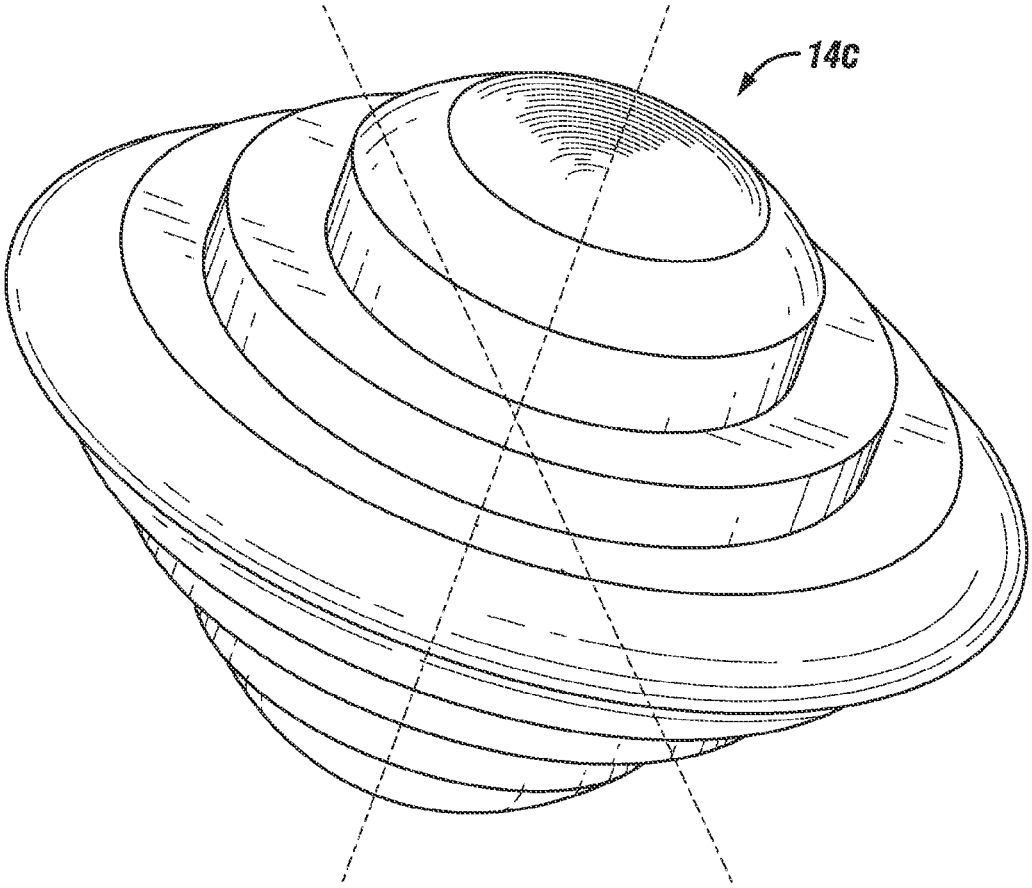
FIG. 4 is a view of another cast carbide cutting element used in conjunction with the composite cutting tool.
Figure 5:
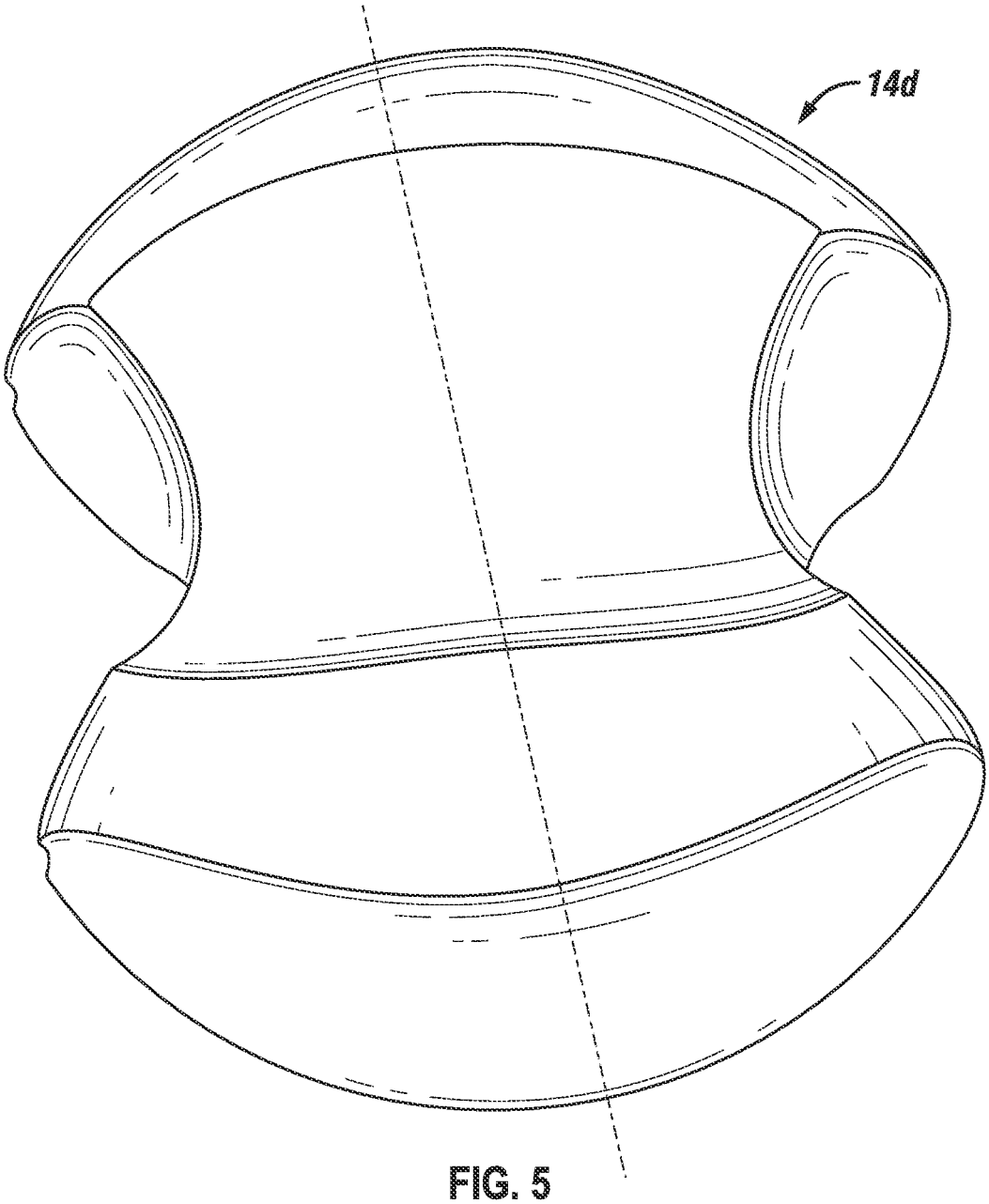
FIG. 5 is a view of another cast carbide cutting element used in conjunction with the composite cutting tool.
Figure 6:
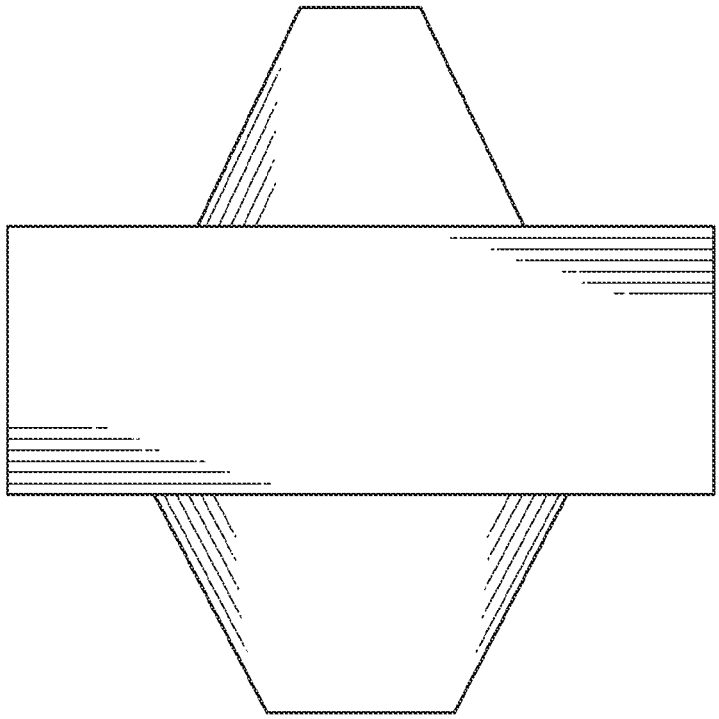
FIG. 6 is a front view of the cast carbide cutting element of FIG. 2.
Figure 7:
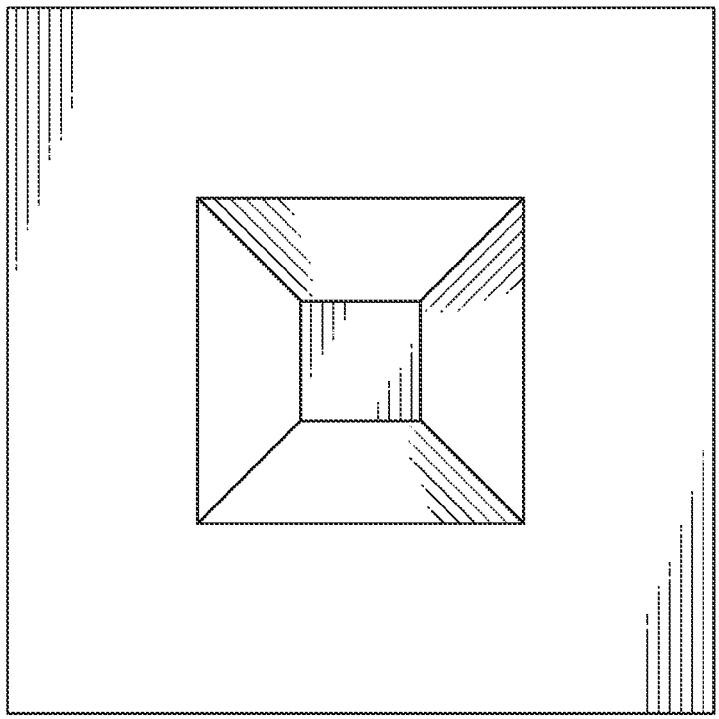
FIG. 7 is a top view of the cast carbide cutting element of FIG. 2.
Figure 8:
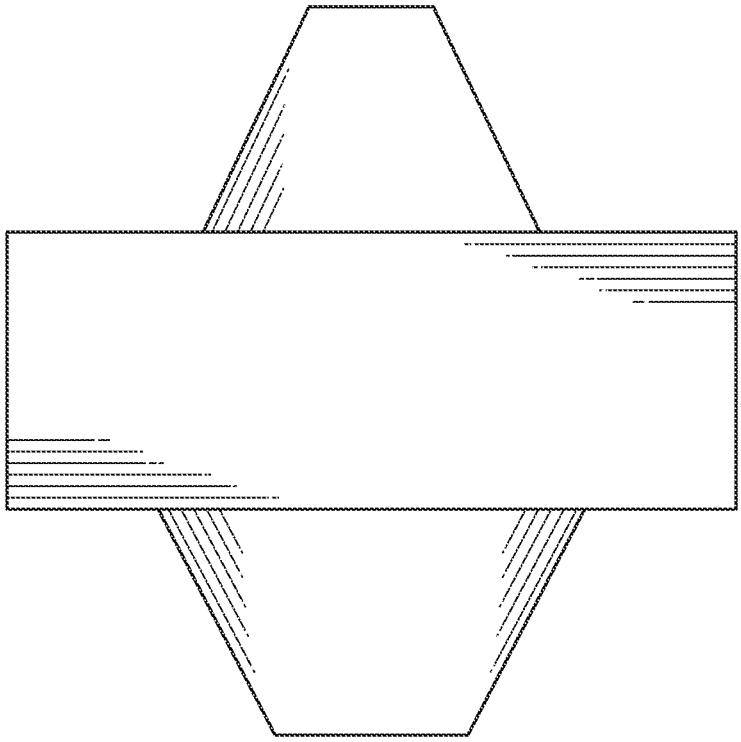
FIG. 8 is a side view of the cast carbide cutting element of FIG. 2.
Figure 9:
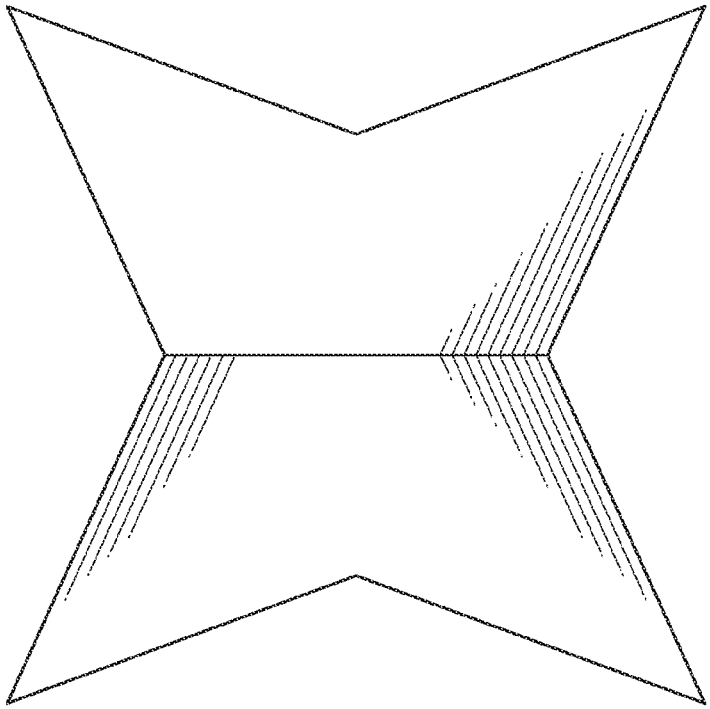
FIG. 9 is a front view of the other cast carbide cutting element of FIG. 3
Figure 10:
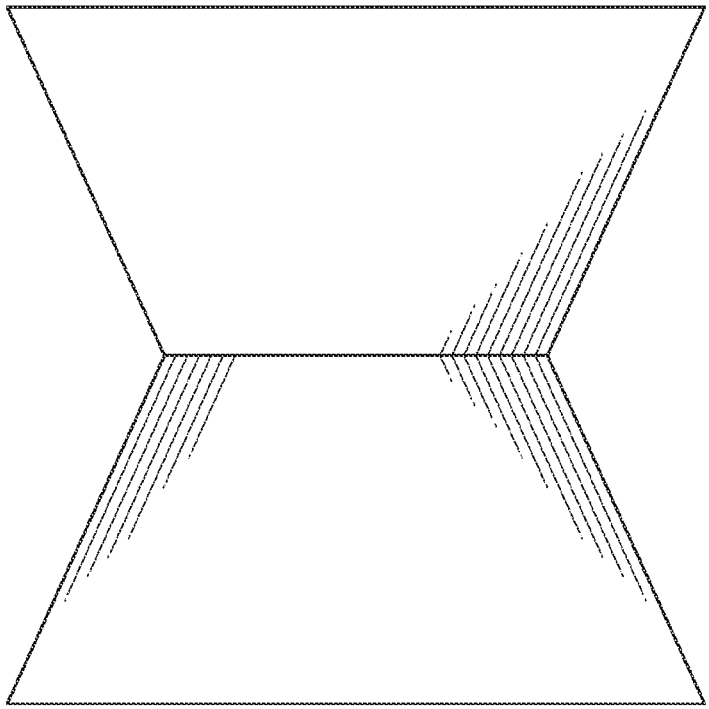
FIG. 10 is a side view of the other cast carbide cutting element of FIG. 3.
Figure 11:
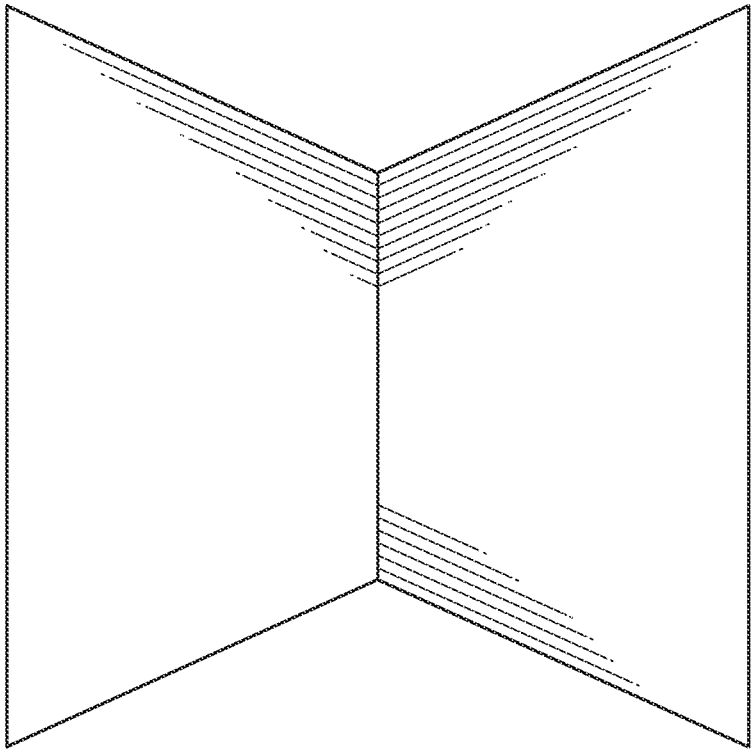
FIG. 11 is a top view of the cast carbide cutting element of FIG. 3.

Referring to FIGS. 4 and 5, additional shapes of cutting elements 14*c* and 14*d* are illustrated. These shapes may be substituted for or added to the shapes of FIGS. 2 and 3 in particular tools as desired. There will always however be at least two pluralities of substantially similarly shaped cutting elements attached to the tool body 11.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A cutting/milling tool comprising:

a tool body;

a cutting end of the tool body;

a first plurality of cutting elements having a substantially identical shape and shaped as illustrated in FIG. 2 or shaped as illustrated in FIG. 3 disposed at the cutting end of the tool body; and a second plurality of cutting elements having a different shape than the first plurality of cutting elements, the second plurality of cutting elements being substantially identical in shape to each other, the second plurality of cutting elements being interspersed with the first plurality of cutting elements at the cutting end of the tool body, the second plurality of cutting elements being positionally fixed on the cutting end of the tool body relative to the first plurality of cutting elements during operation of the cutting/milling tool.

2. A cutting/milling tool as claimed in claim 1 wherein the cutting elements are cast.

3. A cutting/milling tool as claimed in claim 1 wherein at least one of the first plurality of cutting elements and the second plurality of cutting elements are distributed randomly about the cutting end of the tool body.

4. A cutting/milling tool as claimed in claim 1 wherein at least one of the first plurality of cutting elements and the second plurality of cutting elements are oriented randomly about the cutting end of the tool body.

5. A cutting/milling tool as claimed in claim 1 wherein the first plurality of cutting elements are of consistent hardness.

6. A cutting/milling tool as claimed in claim 1 wherein the first plurality of cutting elements are of inconsistent hardness.

7. A cutting/milling tool as claimed in claim 6 wherein the inconsistent hardness is two hardnesses and the harder of the two hardnesses is located toward a periphery of the tool.

8. A cutting/milling tool as claimed in claim 1 wherein one or more additional pluralities of cutting elements that are shaped differently than either the first plurality of cutting elements or the second plurality of cutting elements are disposed at the cutting end of the tool, each element of the one or more additional plurality of cutting elements being substantially identical in shape to each other.

9. A cutting/milling tool as claimed in claim 1 wherein the first plurality and second plurality of cutting elements are of different sizes from one another.

10. A cutting/milling tool as claimed in claim 1 wherein the first plurality and second plurality of cutting elements are of differing hardness from one another.

11. A method for making a cutting/milling tool comprising:

selecting a first plurality of consistently shaped cutting elements shaped as illustrated in FIG. 2 or shaped as illustrated in FIG. 3;

selecting a second plurality of consistently shaped and sized cutting elements; and attaching each plurality of cutting elements to a cutting end of the tool such that the first plurality of consistently shaped and sized cutting elements remain positionally fixed relative to the second plurality of consistently shaped and sized cutting elements during operation of the cutting/milling tool.

12. A method for making a cutting/milling tool as claimed in claim 11 wherein the method further comprises positioning individual ones of one or more of the first plurality or second plurality of cutting elements having relatively greater hardness toward a periphery of the tool during the attaching.

13. A method for making a cutting/milling tool as claimed in claim 11 wherein the method comprises selecting one or more additional pluralities of cutting elements for attachment to the tool.

14. A method for making a cutting/milling tool as claimed in claim 11 wherein the second plurality is of a different size than the first plurality.

* * * * *